US006030250A

United States Patent [19]

Sawayanagi et al.

[11] Patent Number: 6,030,250

[45] Date of Patent: Feb. 29, 2000

[54] LEVER ENGAGEMENT TYPE CONNECTOR

[75] Inventors: Masahiro Sawayanagi; Nobuyuki Akeda, both of Shizuoka-ken, Japan

[73] Assignee: Yazaki Corporation, Tokyo, Japan

[21] Appl. No.: 08/951,498

[22] Filed: Oct. 16, 1997

[30] Foreign Application Priority Data

Oct. 16, 1996 [JP] Japan ..... 8-273659

[51] Int. Cl.[7] ..... H01R 13/62

[52] U.S. Cl. ..... 439/372

[58] Field of Search ..... 439/372, 310, 439/157, 215

[56] References Cited

U.S. PATENT DOCUMENTS

| | | | |
|---|---|---|---|
| 5,252,086 | 10/1993 | Russell | 439/215 |
| 5,722,843 | 3/1998 | Kerckhof | 439/157 |
| 5,829,994 | 11/1998 | Oda | 439/157 |

FOREIGN PATENT DOCUMENTS 8-83645 3/1996 Japan .

*Primary Examiner*—Neil Abrams
*Assistant Examiner*—Javaid Nasri
*Attorney, Agent, or Firm*—Finnegan, Henderson, Farabow, Garrett & Dunner, L.L.P.

[57] ABSTRACT

A lever engagement type connector comprises a first connector (1) having a connector housing (4), the first connector (1) having a through portion (10) formed in the connector housing (4) for being inserted with a front end of a lever (3), the first connector (1) further having a bearing portion (12) for supporting the rotation of the lever (3); and a second connector (2) for being connected to the first connector (1) by the rotation of the lever (3), the second connector (2) having a connector housing (13), the second connector (2) further having an engaging protrusion (16) formed in the connector housing (12) for being engaged with the front end of the lever (3).

7 Claims, 22 Drawing Sheets

LEVER ENGAGEMENT TYPE CONNECTOR

BACKGROUND OF THE INVENTION

1. Field of the Invention

This invention relates to a lever engagement type connector in which a pair of connector housings are engaged with each other by rotating the lever.

2. Description of the Related Art

In the lever engagement type connector, a rotatable lever is utilized to reduce the engagement force required for engaging a pair of male and female connectors to allow an easy engagement therebetween. In a related art disclosed in Japanese Patent Application Laid Open No. 8-83645, a lever used in a lever engagement type connector has a structure in which a pair of right and left acting pieces are connected with each other by an operating piece. On the opposing faces of the aforementioned acting pieces engaging pins are formed such that they oppose each other. Further, engaging grooves are formed in the vicinity of the aforementioned engaging pins such that they oppose each other.

The aforementioned engaging pins are inserted into grooves formed in the housing of either the male connector or the female connector (not shown). Pin portions are formed on the external faces of the housing of the other connector such that they are protruding and are inserted into the engaging grooves. By rotating the aforementioned operating piece, the opposing connectors are brought into contact with each other so that they are engaged. In use, the lever is movable over the housing of one connector such that the operating pieces contact the external faces of both sides of the housing.

In the case of such a conventional lever engagement type connector, however, the lever is mounted on the external faces of both the connectors and it is necessary to appropriately size the lever to the housing and the external configuration of the connectors. Therefore, depending on the number of pins to be connected and the size of each housing, variously sized levers are is needed, so that the selection thereof becomes troublesome. Further, because a lever necessary for a large housing has a long operating piece corresponding to that housing, the strength of the lever is reduced.

Further, because the pin portions are protruding from the external faces of the housing of the connectors, there is not only a restriction in reduction of the connector size, but also the pin portions are likely to be caught by outside members, potentially causing the connectors to be disengaged from each other.

Additionally, because the lever can be removed from the housing even if the engagement between the housings has not been completed, not only is the lever likely to be removed during the engagement operation, but it is also difficult to recognize whether that engagement has been completed.

SUMMARY OF THE INVENTION

The present invention has been proposed to solve the above described problems. An object of the present invention is to provide a lever engagement type connector wherein, even if the size of a connector housing or its external shape is changed, the same lever can be utilized for the engagement of the connecters, strength of the lever is not decreased, and the connector housing can be reduced in size.

Another object of the present invention is to provide a lever engagement type connector wherein the lever never becomes disengaged during the engagement operation of the connectors.

To achieve the objects, according to a first aspect of the invention, there is provided a lever engagement type connector, comprising a first connector having a connector housing, the first connector having a through portion formed in the connector housing for being inserted with a front end of a lever, the first connector further having a bearing portion for supporting the rotation of the lever; and a second connector for being connected to the first connector by the rotation of the lever, the second connector having a connector housing, the second connector further having an engaging protrusion formed in the connector housing for being engaged with the front end of the lever.

In this structure, the front end of the lever is inserted into the through portion formed in the connector housing and the front end is engaged with the engaging protrusion. With the lever being supported by the bearing portion, the lever is rotated. As a result, the second connector is brought into contact with the first connector, so that they are engaged with each other.

Thus, the lever is inserted into an interior of the first connector and then rotated. Therefore, unlike the conventional example, this lever does not have to ride over the connector such that it is in contact with external faces thereof. Regardless of a number of poles to be connected, size of the housing and modified outside shape of the connector, the lever can be used commonly. Further, the lever does not have to be enlarged corresponding to an increased size of the connector, and thus reduction in strength due to the enlargement does not occur. Further, because the engaging protrusion with which the lever is engaged corresponds to a portion in which the lever goes through, the engaging protrusion is formed inside the second connector, so that the engaging protrusion is not protruded outside. Therefore the connector size can be reduced and there never occurs a case in which outside members may be hooked by the connector.

According to a second aspect of the invention, there is provided a lever engagement type connector, comprising: a first connector having a connector housing, the first connector having a through portion formed in the connector housing for being inserted with a front end of a lever, the first connector further having a bearing portion for supporting the rotation of the lever, the first connector further having a guide portion engagedly guiding the lever in an engagement direction of the lever engagement type connector; and a second connector for being connected to the first connector by the rotation of the lever, the second connector having a connector housing, the second connector further having an engaging protrusion formed in the connector housing for being engaged with the front end of the lever.

In this structure also, the engagement of the first and second connectors can be carried out by inserting the lever into the through portion in the connector housing of the first connector such that the end thereof is engaged with the engaging protrusion of the second connector. Because the guide portion guides the rotation of the lever in the direction that the first and second connectors become engaged with each other while being engaged with the lever, the first and second connectors can be engaged with each other securely and the lever can be rotated stably.

According to the third aspect of the invention, as it depends from the first or second aspect, the through portion is formed in a substantially central portion of the housing of the first connector, the lever is rotated in the substantially central portion in the transverse direction of the first connector.

Because the through portion in which the lever goes through is formed in the substantially central portion of the housing of the first connector, the lever is rotated in the substantially central portion of the housing. Thus, the rotation force of the lever is transmitted equally to the right and left sides, so that the housing is not inclined to one side of the right and left sides, thereby securing a smooth engagement of the first and second connectors.

According to a fourth aspect of the invention, as it depends from the one aspect among the first aspect to the third aspect, the bearing portion is constructed by a pair of right and left bearing portions for receiving a pair of right and left rotary shafts formed on the lever.

Because a pair of the right and left rotary shafts are formed on the lever, the rotation of the lever is supported equally on the right and left sides, thereby securing a stable rotation thereof.

According to a fifth aspect of the invention, as it depends from the one aspect among the first aspect to the fourth aspect, the engaging protrusion is constructed by a pair of right and left engaging protrusions for engaging with a pair of right and left engaging portions formed at a front end of the lever.

Because the pair of the right and left engaging portions formed on the lever are engaged with the pair of the right and left engaging protrusions of the second connector, movement of the second connector by the rotation of the lever becomes equal on the right and left sides thereby securing a smooth engagement.

According to a sixth aspect of the invention, as it depends from the second aspect, the guide portion has a length where the guide portion is engaged with a lever only in an interval of time from an initial time of the lever rotation to completion of the engagement between the first and the second connectors.

Because the guide portions are engaged with the lever portion in the interval of time from the initial time of the rotation of the lever to completion of the engagement of the first and second connectors, the rotation of the lever is stabilized. Because the guide portion is engaged with the lever only in this interval of time, the lever never slips out during operation for the engagement.

According to a seventh aspect of the invention, as it depends from the second aspect or the sixth aspect, the guide portion has a stopper portion being engaged with the lever at an initial time of the rotation of the lever for inhibiting the lever from being rotated in a direction where the first and the second of the connectors are disengaged.

Because the stopper portion is formed on the guide portion, the lever is inhibited from being rotated in the disengagement direction but rotated only in the engagement direction. Thus, there is eliminated a possibility of such a mistake in which the lever is rotated in the disengagement direction, that is, a, misoperation is eliminated.

According to an eighth aspect of the invention, as it depends from the second aspect, the sixth aspect or the seventh aspect, the terminal end portion of the guide portion is formed as a free end allowing the lever to be removed out of the connector housing of the first connector.

Because, when the engagement of the first and second connectors is completed, the lever has reached the terminal portion of the guide portion while this terminal portion acts as a free end, the lever can be removed easily.

According to a ninth aspect of the invention, as it depends from the second aspect, the sixth aspect, the seventh aspect or, the eighth aspect, the guide portion is constructed by a pair of right and left guide portions slidingly guiding a pair of right and left guide protrusions formed on the lever.

Because the guide protrusions are formed, the engagement between the lever and the guide portions is made secure.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
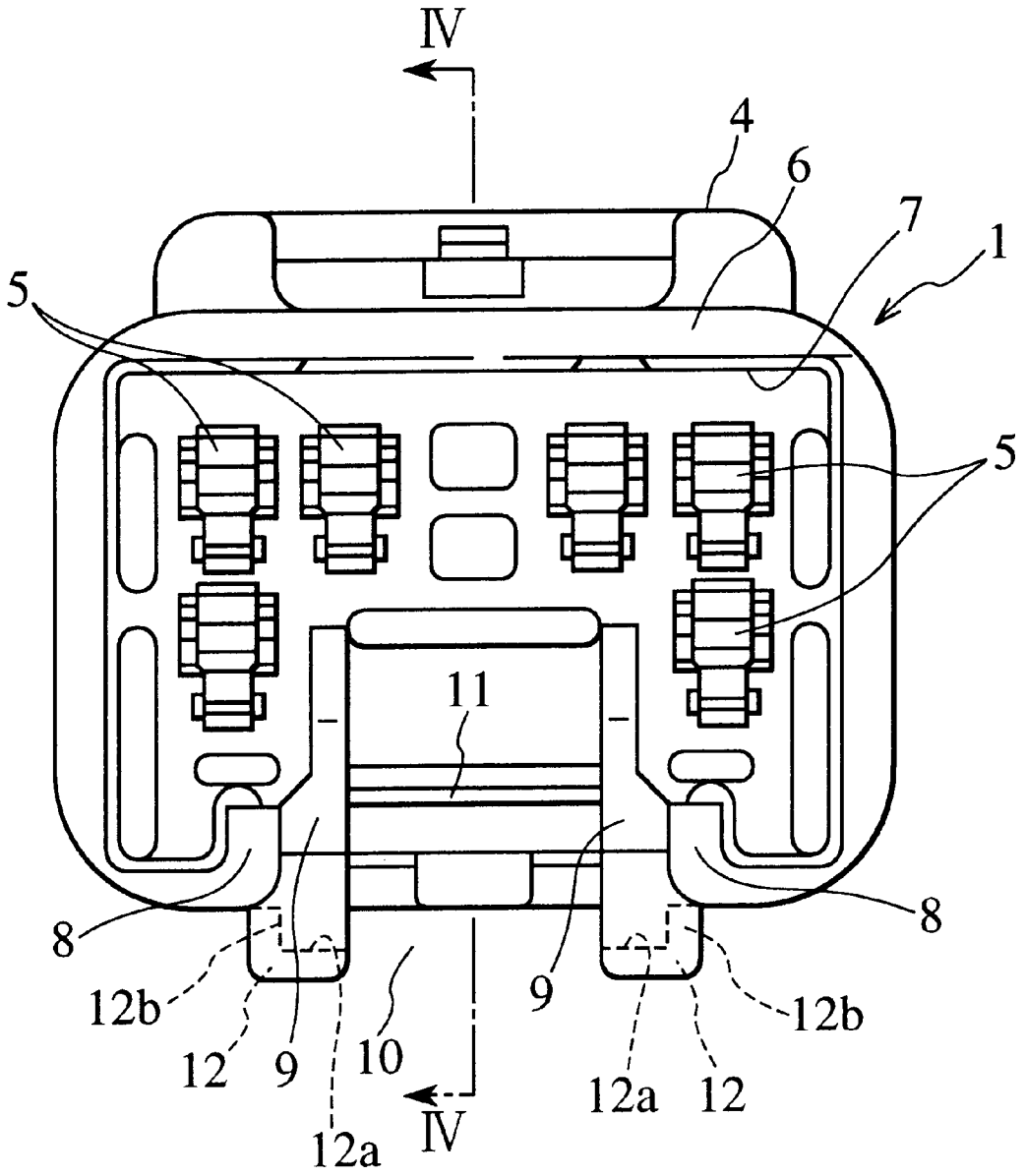
FIG. 1 is a front view of a female connector according to a first embodiment of the present invention.

There will be detailed below the preferred embodiments of the present invention with reference to the accompanying drawings. Like members are designated by like reference characters.

Figure 8:
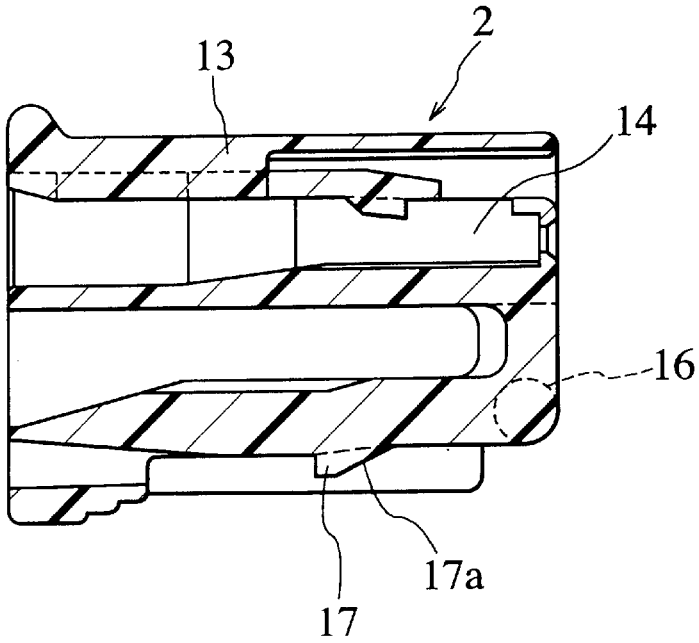
FIG. 8 is a sectional view taken along the lines VIII—VIII in FIG. 5.
Figure 9:
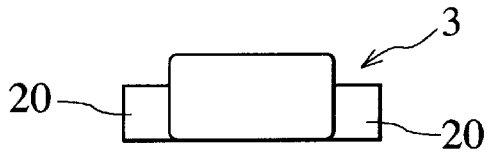
FIG. 9 is a plan view of a lever according to the first embodiment.
Figure 10:
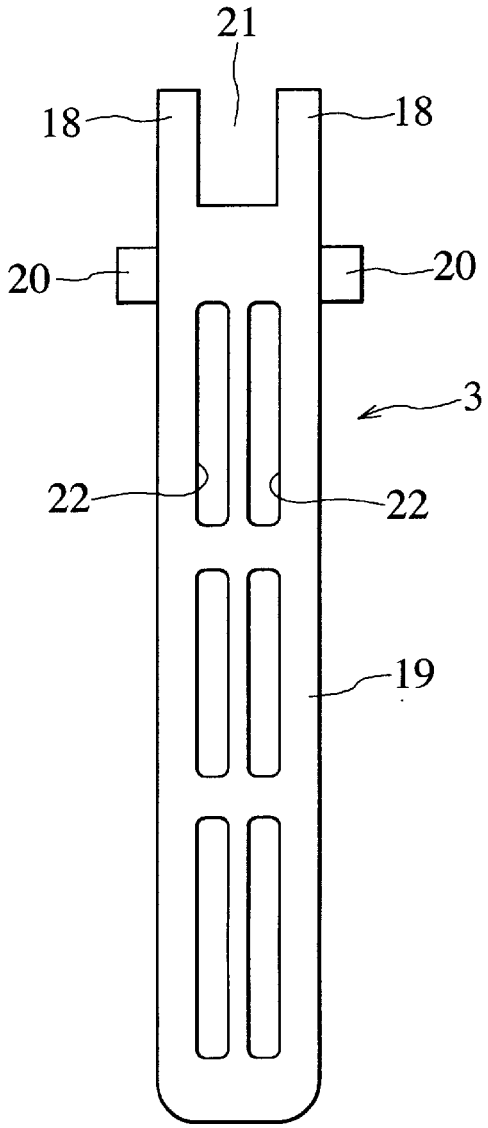
FIG. 10 is a front view of the lever according to the first embodiment.
Figure 11:
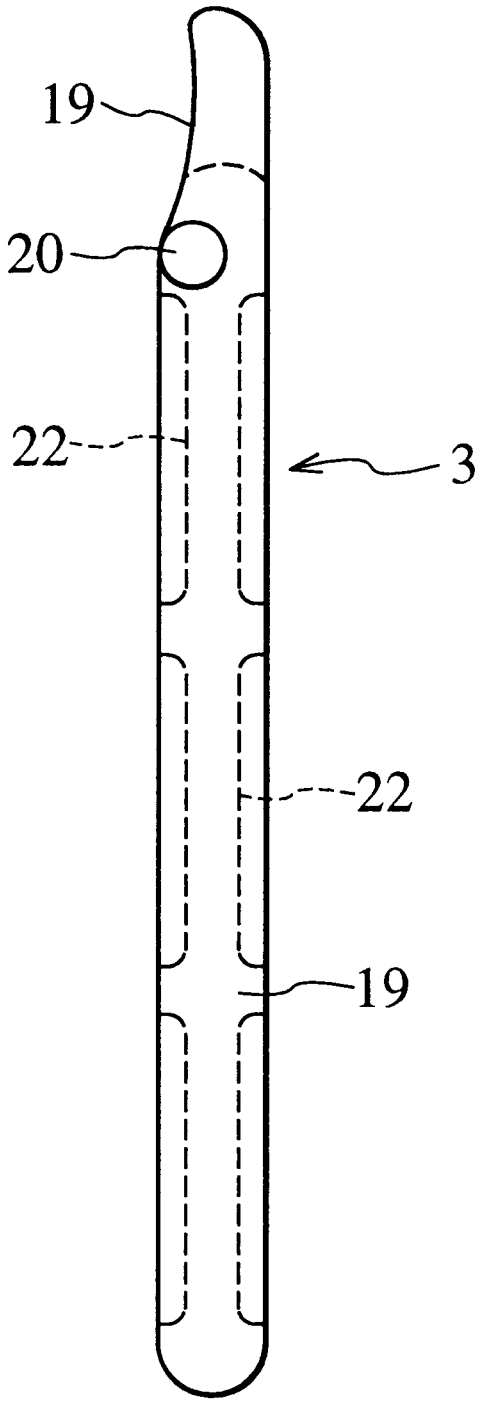
FIG. 11 is a side view of the lever according to the first embodiment.

FIGS. 1–16 show a first embodiment of the present invention. FIGS. 1–4 show a female connector 1 as a first connector and FIGS. 5–8 show a male connector 2 as a second connector. FIGS. 9–11 show a lever 3 for use in the male and female connectors 1, 2. FIGS. 12–16 show an action by operation of the lever 3.

Figure 2:
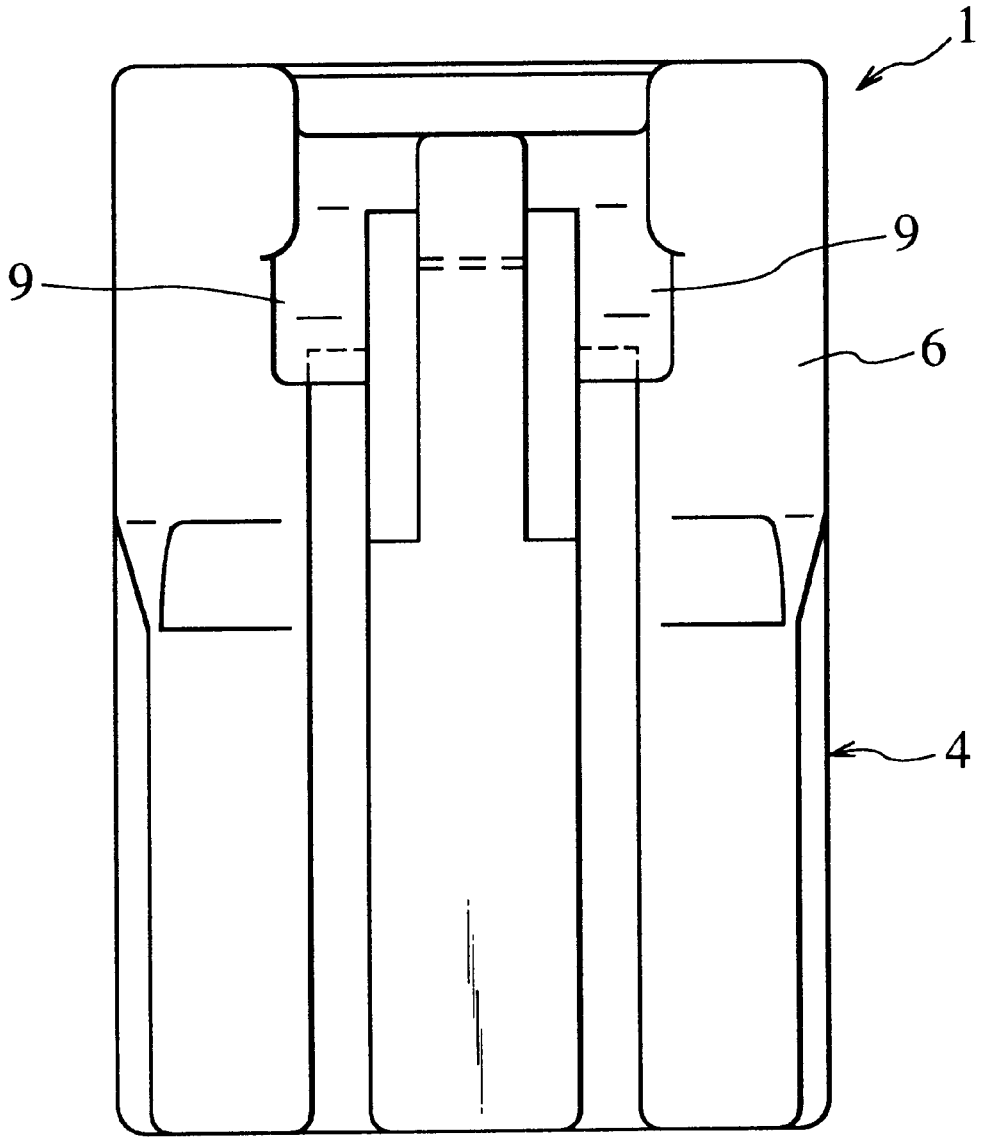
FIG. 2 is a bottom view of the female connector according to the first embodiment of the present invention.
Figure 3:
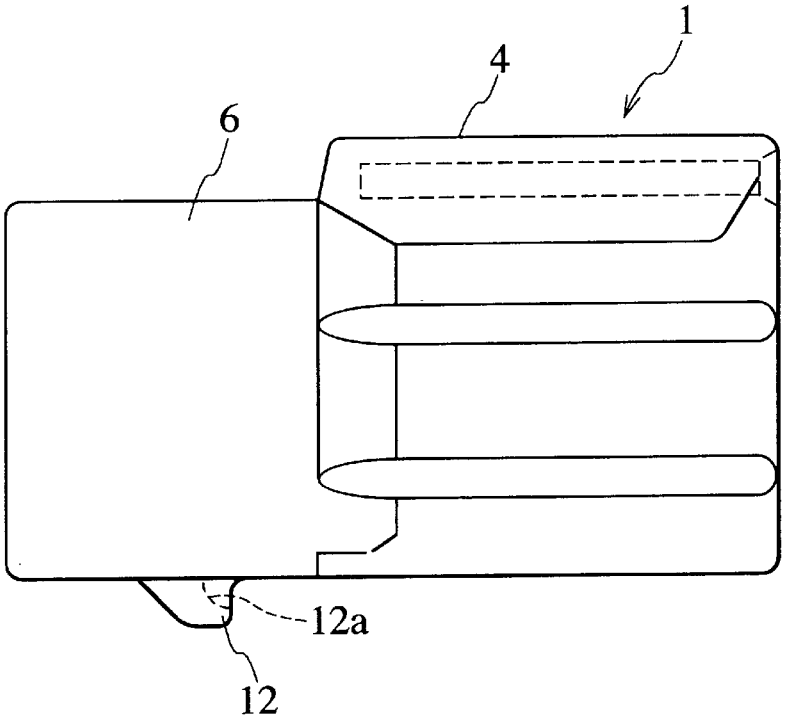
FIG. 3 is a right side view of the female connector according to the first embodiment of the present invention.
Figure 4:
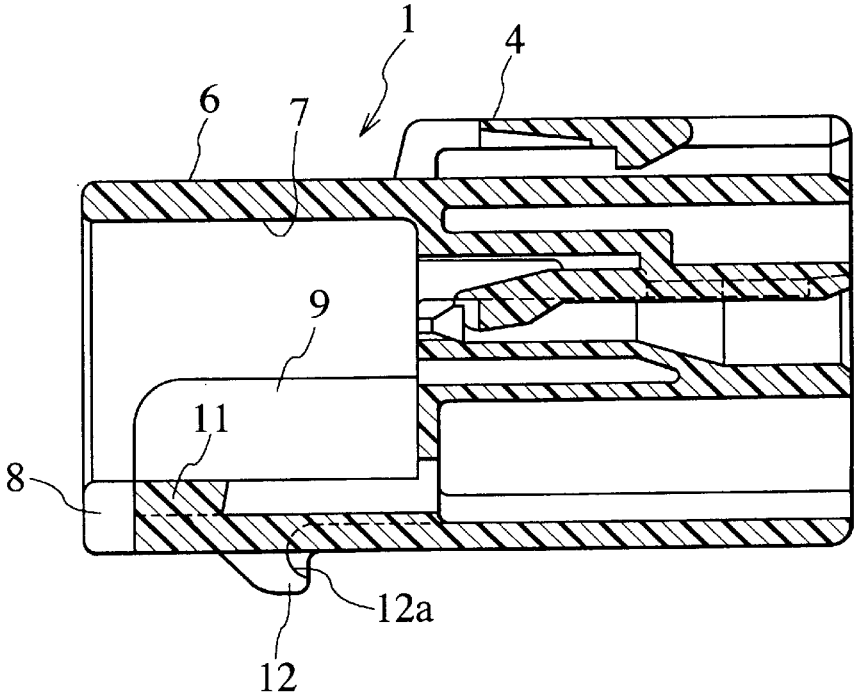
FIG. 4 is a sectional view taken along the lines IV—IV in FIG. 1.

As shown in FIGS. 1–4, the female connector 1 comprises a housing 4. The connector housing 4 is formed symmetrical relative to the axis. The axis is formed of insulating resin such as polybutadiene terephthalate (PBT). Terminals (not shown) are incorporated in a plurality of terminal accommodation rooms 5 formed in the housing 4. As shown in FIG. 3, a hood portion 6 is integrally formed at one side (left side) of the housing 4. As shown in FIG. 4, an insertion port 7 which is a substantially rectangular cavity whose left end is open is formed inside the hood portion 6. The male connector 2 is inserted into this insertion hole 7 and coupled with the female connector 1.

As shown in FIGS. 1, 2, a raised wall 8 is formed on each of both sides of a bottom of the hood portion 6. The raised walls on both sides are isolated from each other. Then, vertical walls 9, 9 which are longer in the vertical direction than the raised walls 8, 8. The vertical walls 9, 9 are also isolated from each other. This separating portion acts as a through portion 10 in which the lever 3 goes through. The through portion 10 is formed in a substantially central portion in the transverse direction (width direction) of the housing 4 of the female connector 1.

A lock step portion 11 is formed inside the hood 6, on a deeper side than the opening end of the insertion port 7. The male connector 2 is engaged with this lock step portion 11, so that the engagement between the connectors 1 and 2 is secured, thereby preventing unintended disengagement.

Figure 14:
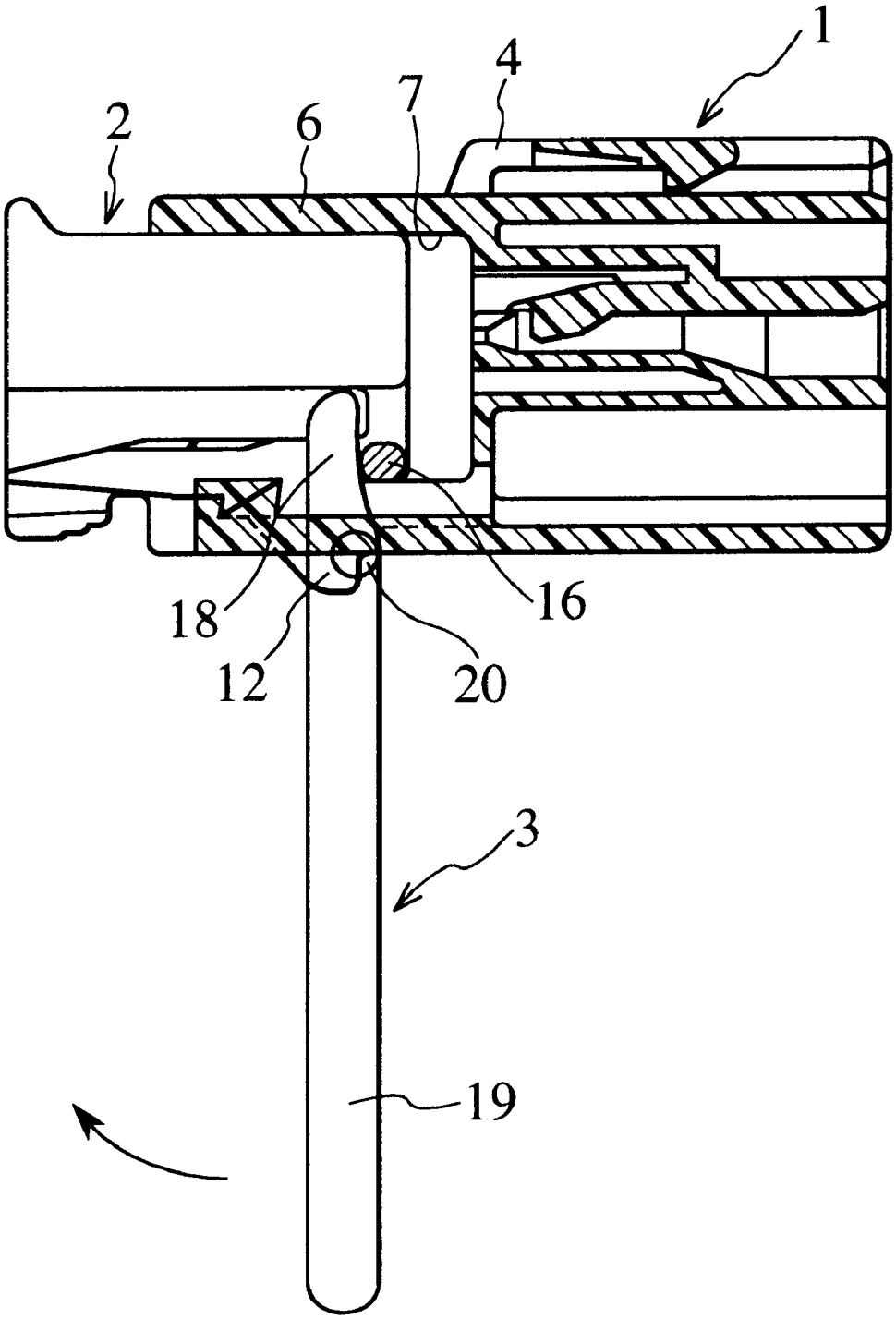
FIG. 14 is a sectional view showing an operation for the rotation of the lever according to the first embodiment.

Lower end portions of the vertical walls 9, 9 extend below a bottom face of the hood portion 6. A pair of bearing portions 12, 12 are formed in the extended portions, which support the rotation of the lever 3. As shown in FIG. 14, supporting faces 12*a*, 12*a* of the bearing portions 12, 12 are formed in a circular shape to support the rotation of the lever 3. External side portions 12*b*, 12*b* of the bearing portions 12, 12 are raised, thereby preventing the lever 3 from disengaging.

The male connector 2 is formed of the same insulating resin as the female connector 1, and as shown in FIGS. 5–8, comprises a housing 13 as a connector housing formed symmetrically relative to the axis. Terminals (not shown) are incorporated in a plurality of terminal accommodation rooms 14 formed in the housing 13. In this embodiment, the terminal accommodation rooms 14 in the male connector 2 are formed at positions corresponding to the terminal accommodation rooms 5 in the female connector 1. When the male connector 2 is engaged with the female connector 1, the terminal accommodation rooms 14, 15 are in communication with each other.

Figure 5:
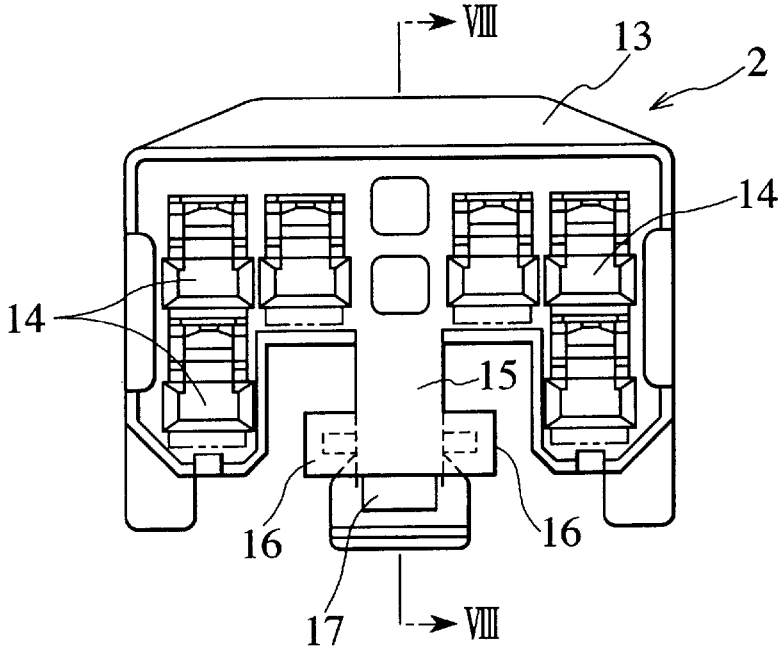
FIG. 5 is a front view of a male connector according to the first embodiment.
Figure 6:
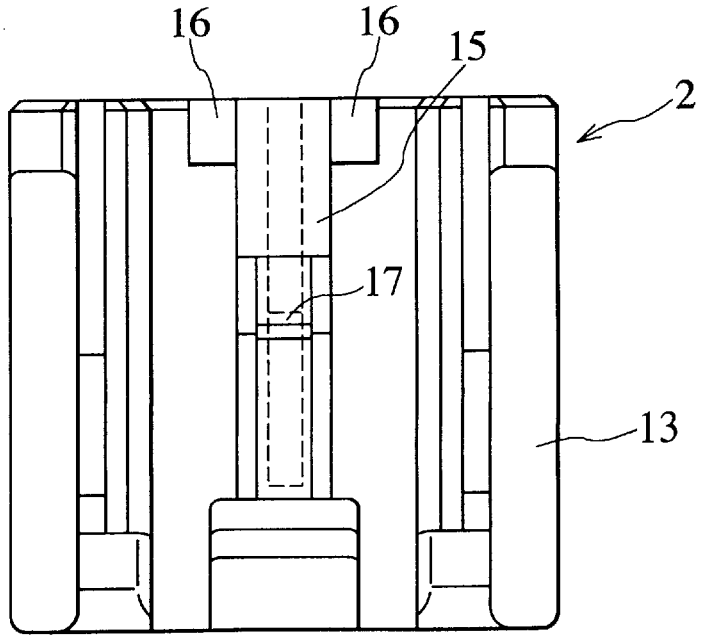
FIG. 6 is a bottom view of the male connector according to the first embodiment.
Figure 7:
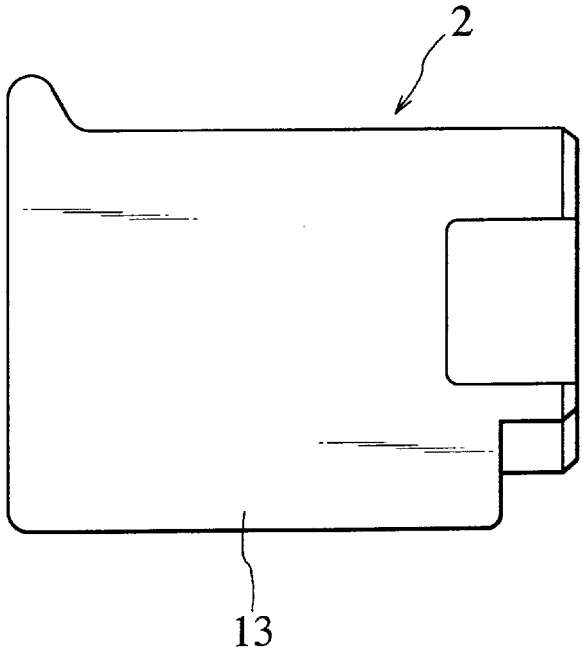
FIG. 7 is a left side view of the male connector according to the first embodiment.

The housing 13 of the male connector 2 is, as shown in FIG. 5, formed to an external shape capable of engaging with the hood portion 6 of the female connector 1. As shown in FIG. 6, a straight portion 15 extending straight along the length of the housing 13 is formed in a central portion of the housing 13. Engaging protrusions 16, 16 and a lock protrusion 17 are formed in this straight portion 15.

The engaging protrusions 16, 16 are formed in pairs (right/left) on an end portion of the straight portion 15 of the male connector 2 as shown in FIGS. 5, 6. The engaging protrusions 16, 16 are located at a lower position of the housing 13 and a front end of the lever 3 which goes through the hood portion 6 of the female connector 1 is engaged with these protrusions. By rotating the lever 3, the male connector 2 is pulled into the inside of the hood portion 6 of the female connector 1. Although in this Figure, an external shape of the engaging protrusion is formed in a circular shape, it may be modified appropriately if it fits to the lever 3.

The lock protrusion 17 is formed on a deeper side than the engaging protrusions 16, 16 and more apart from the female connector 1 than the engaging protrusions 16, 16. This lock protrusion 17 is, as shown in FIGS. 5, 6 and 8, protruded downward from the central portion in the width direction. When the male connector 2 is pulled into the female connector 1, the lock protrusion 17 is engaged with the lock step portion 11 of the female connector 1.

According to the present embodiment, and as shown in FIG. 8, the bottom face of the lock protrusion 17 is formed as a tapered face 17*a* in which an amount of the protrusion gradually increases as it goes farther off the female connector 1, the tapered face 17*a* slides over the lock step portion 11 of the female connector 1. After the connectors 1, 2 are engaged with each other, the lock protrusion 17 meshes with the lock step portion 11, thereby enhancing the engagement.

As shown in FIGS. 9–11, the lever 3 is formed of the same insulating resin as the housings 4, 13 of the connectors 1, 2 in a long rectangular shape. As shown in FIG. 10, a front end of the lever 3 is branched to two pieces and the respective branched pieces are curved, as shown in FIG. 11, so as to form a pair of engaging portions 18, 18 for engaging the engaging protrusions 16 of the male connector 2. A portion opposite the engaging portions 18, 18 serves as an operating portion 19 for manual operation.

Further, a pair of rotary shafts 20, 20 are formed so as to protrude from the lever 3. The rotary shafts 20, 20 are formed in a circular shape in the vicinity of the engaging portions 18, 18. The rotary shafts 20, 20 are received by the bearing portion 12, of the female connector 1, such that they are rotatable.

An insertion slit portion 21 is provided between the engaging portions 18 and 18 in which the straight portion 15 of the male connector 2 is inserted. A plurality of slip preventing grooves 3, which prevent a slip upon operating this lever are formed on upper and lower surfaces of the operating portion 19.

Next, assembly of the connectors 1, 2 according to the present embodiment will be described with reference to FIGS. 12–16.

Figure 12:
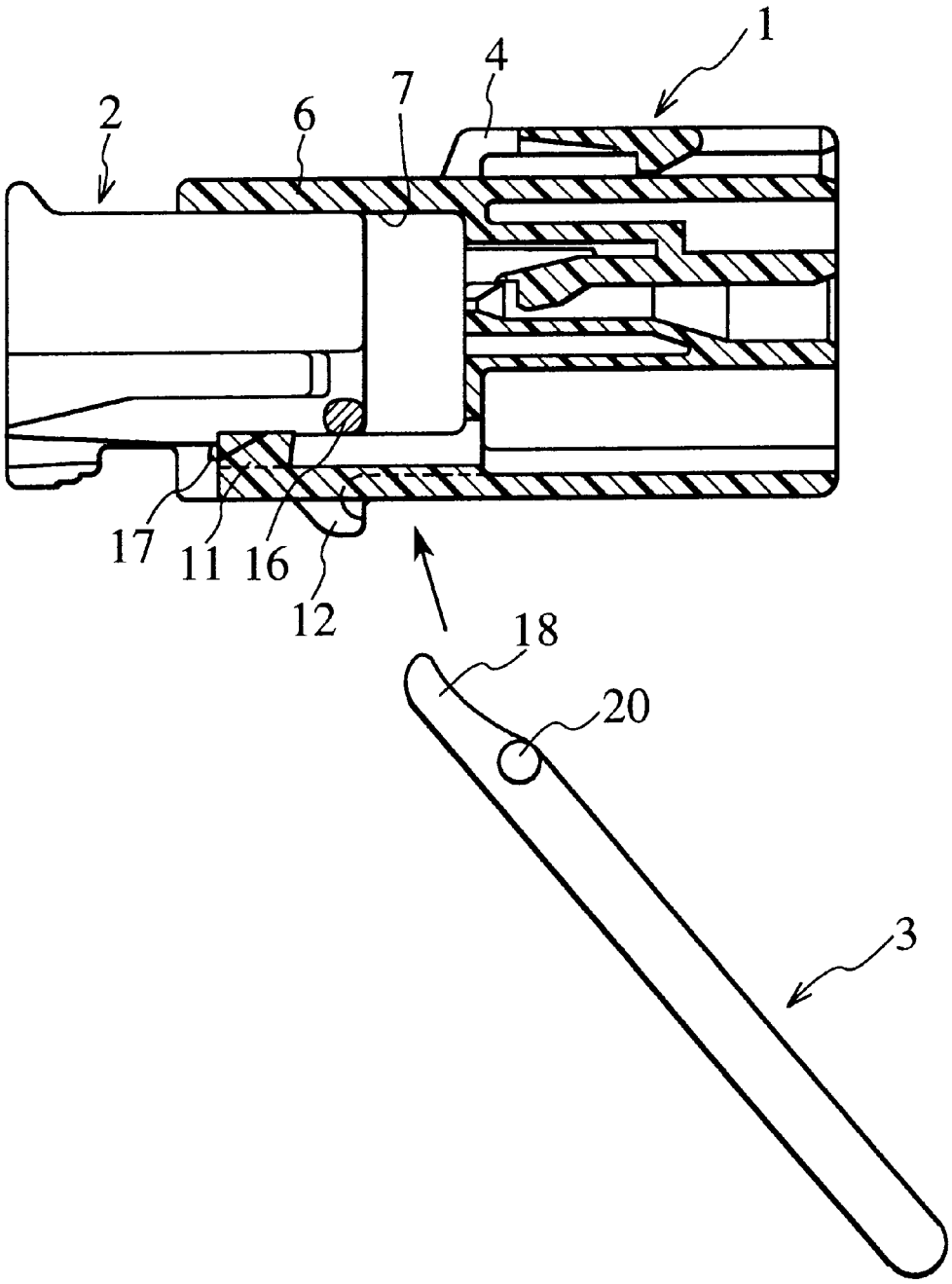
FIG. 12 is a sectional view showing an operation for mounting the lever according to the first embodiment.

First, as shown in FIG. 12, the male connector 1 is inserted into the insertion port 7 through an opening end of the hood portion 6 of the female connector 1. Next, the engaging portions 18 at a front end of the lever 3 are inserted from below into the through portion 10 of the female connector 1.

Figure 13:
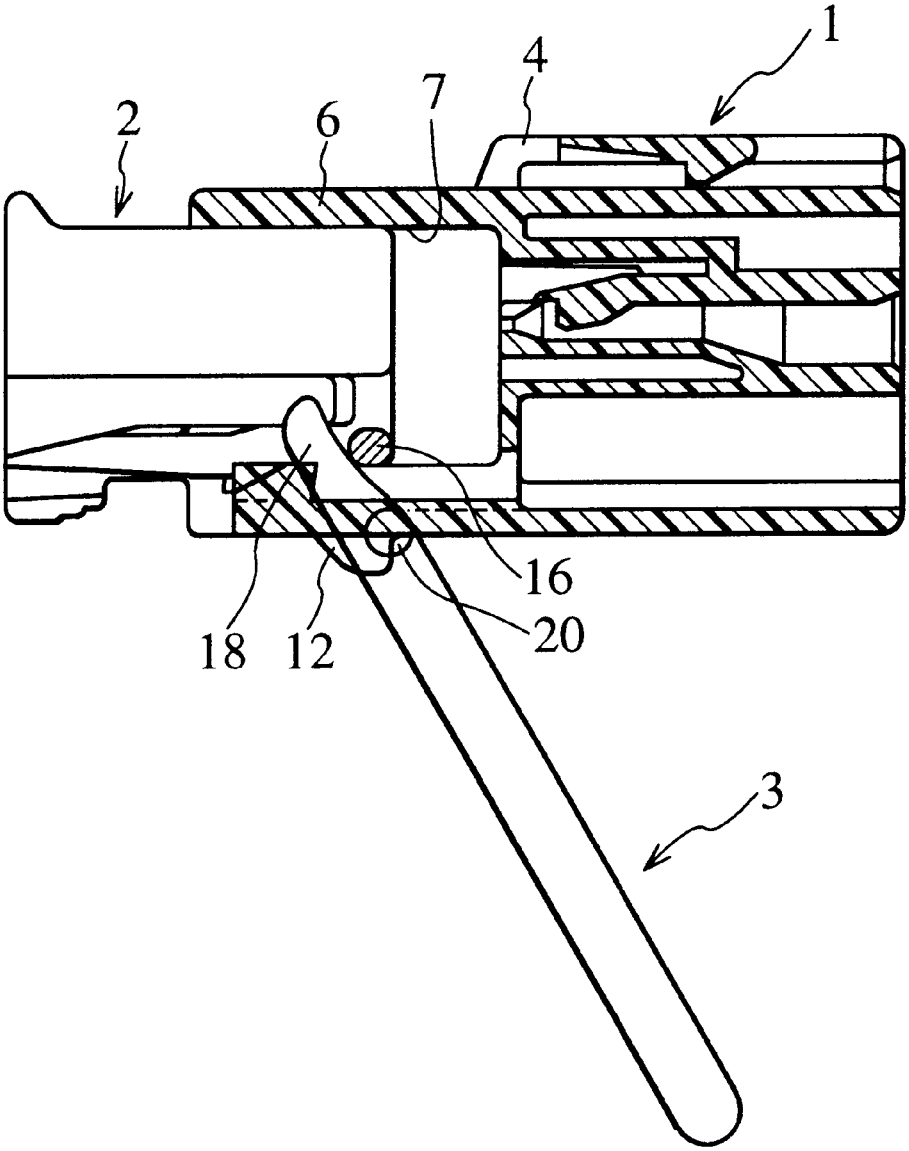
FIG. 13 is a sectional view showing a state in which the lever according to the first embodiment is mounted.

As shown in FIG. 13, the front end of the lever 3 is inserted through the through portion 10 such that a pair of the rotary shafts 20, 20 of the lever 3 are made into contact with the bearing portions 12, 12 of the male connector 2. As a result, the engaging portions 18 of the lever 3 face the engaging protrusions 16 of the male connector 2.

Then, as shown in FIG. 14, a rotary force is applied to the operating portion 19 of the lever 3 so as to rotate the lever 3 in the clockwise direction indicated by an arrow, or in such a direction that the connectors 1, 2 are engaged with each other. The rotary shafts 20, 20 of the lever 3 are received by the supporting faces 12*a*, 12*a* of the bearing portions 12, 12 of the female connector 1 such that they are rotatable. As a result, the rotary shafts 20, 20 act as a fulcrum so that the engaging portions 18 of the lever 3 come into contact with the engaging protrusions 16 of the male connector 2 thereby pushing the male connector 2 into the hood 6 of the female connector 1.

Figure 15:
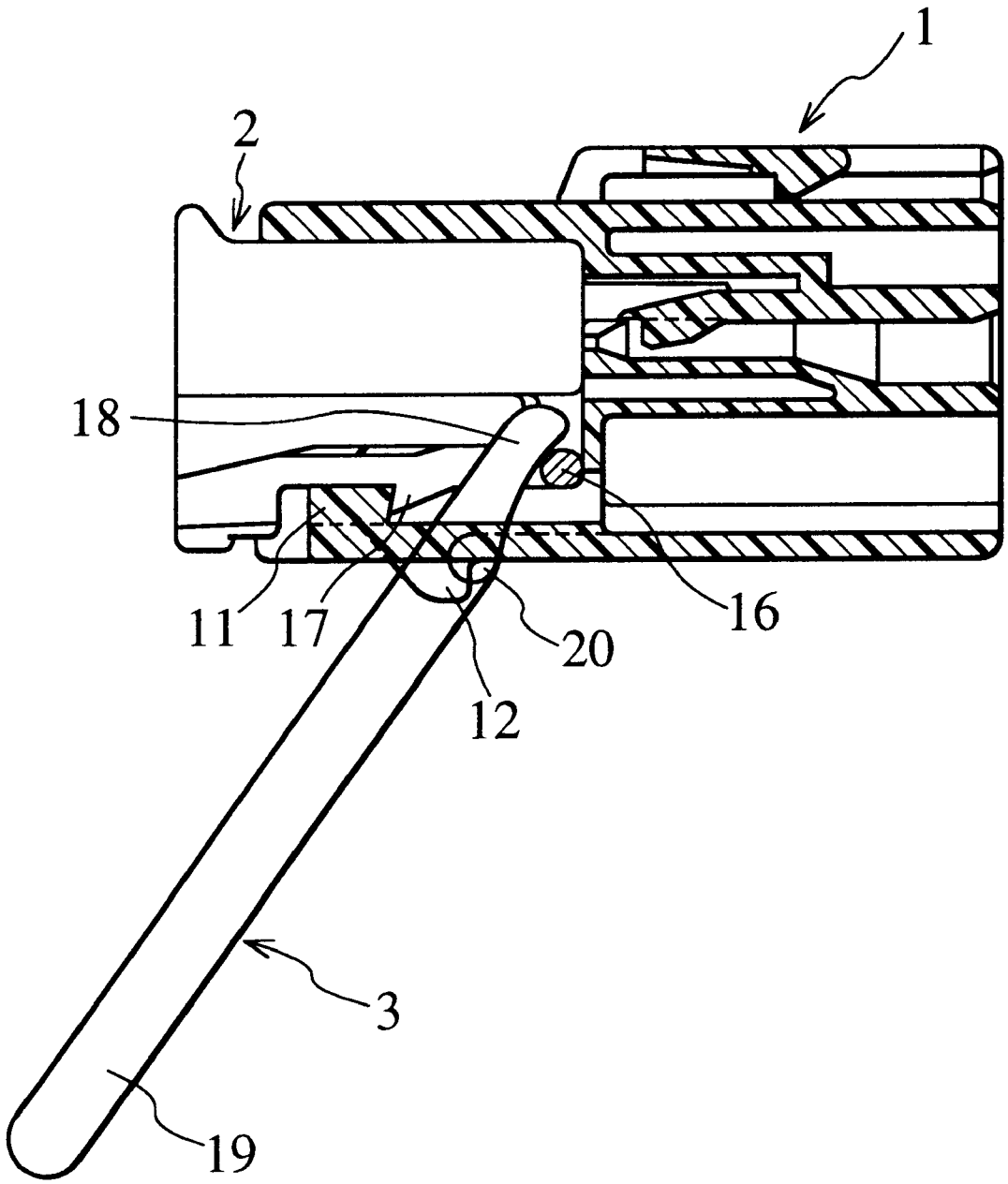
FIG. 15 is a sectional view showing a state in which the engagement according to the first embodiment is completed.
Figure 16:
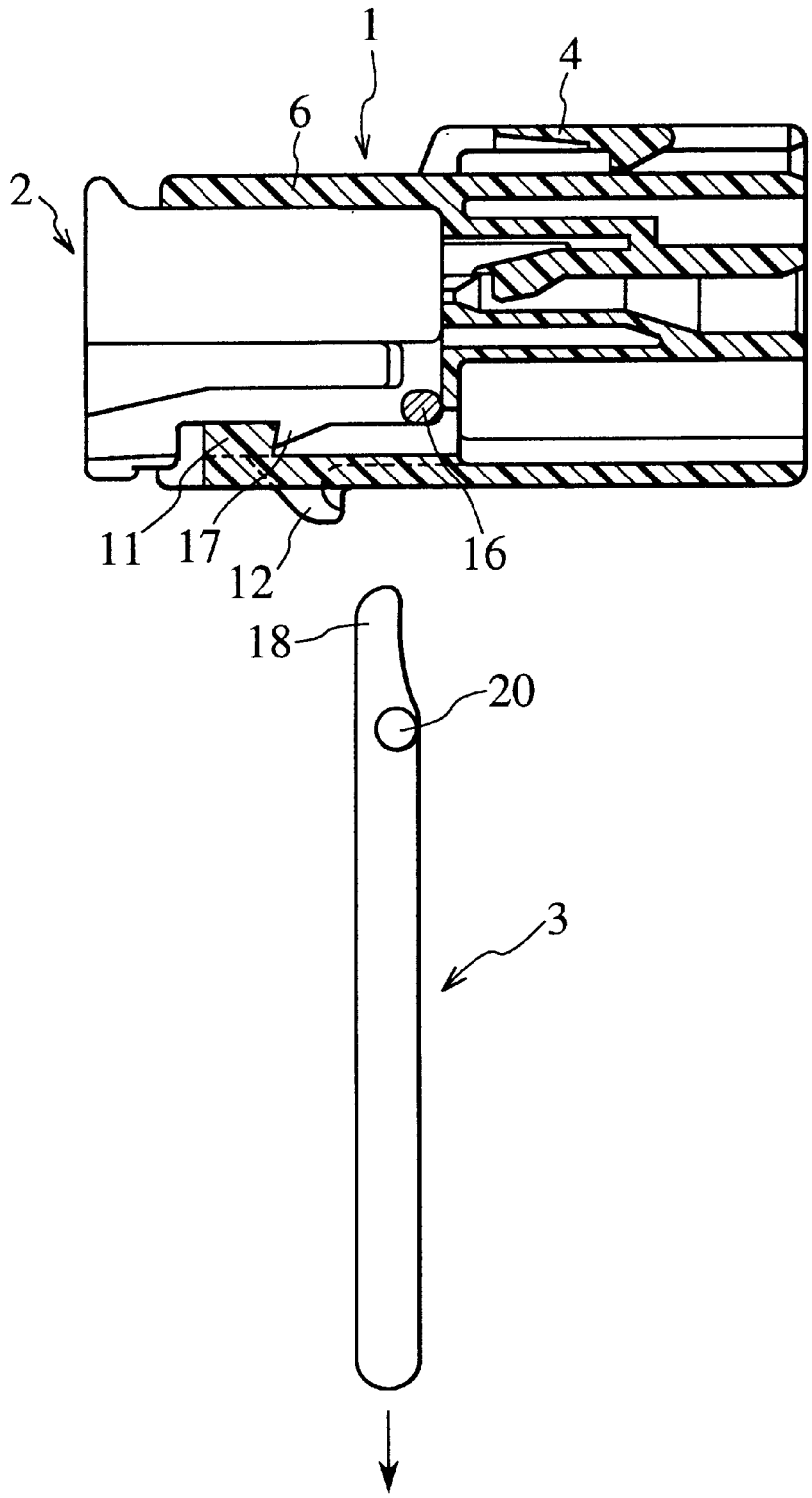
FIG. 16 is a sectional view showing a state in which the lever according to the first embodiment is removed.

By further rotating the lever 3, as shown in FIG. 15, the male connector 2 is moved linearly within the hood portion 6. At this time, the lock protrusion 17 of the male connector 2 slides on the lock step portion 11 of the female connector 1, so that the male connector 2 is moved while the straight portion 15 of the male connector 2 is subject to elastic deformation.

Then, if the lock protrusion 17 goes beyond the lock step portion 11, the straight portion 15 is restored from elastic deformation, so that the lock protrusion 17 is engaged with the lock step portion 11. Consequently, the engagement between the male connector 2 and the female connector 1 is completed. After this engagement is completed, the lever 3 is removed from the female connector 1 and then the engagement procedure is terminated.

According to this embodiment, because the lever 3 goes through the through portion 10 of the female connector 2 and is rotated so as to engage the connectors 1, 2, the lever does not ride over any connector. Even a connector whose size or shape is modified can be also utilized commonly. Thus, it is not necessary to enlarge the lever 3, corresponding to an increased size of the connector. Further, even if the connector size is enlarged, its strength never drops. Further, because the engaging protrusions 16 with which the lever 3 is to be engaged is provided inside the male connector 2, so that it is never protruding out of the connector 2, the connector size can be reduced and further it is never hooked by outside members.

Because, according to the present embodiment, the through portion 10 through which the lever 3 goes is formed in a substantially central portion of the hood portion 6 of the housing, the lever 3 is rotated in the substantially central portion of the housing of the female connector 1. Thus, the rotation force of the lever 3 is transmitted equally on the right and left sides of the male connector 2, so that the lever 3 is not inclined to any one side thereby allowing a smooth engagement.

Further, because a pair of the rotary shafts 20, 20 (right/left) are formed on the lever 3 is supported equally on the right and left sides, so that a stabilized rotation can be achieved. A pair of the engaging portions 18, 18 are formed on the right and left of the lever 3. These engaging portions 18,18 are engaged with the engaging protrusions 16, 16 which are provided each on the right and left sides of the male connector 2. Thus, a movement of the male connector 2 by the rotation of the lever 3 is equalized between the right and left sides of the connector 2, thereby ensuring a smooth engagement.

Figure 25:
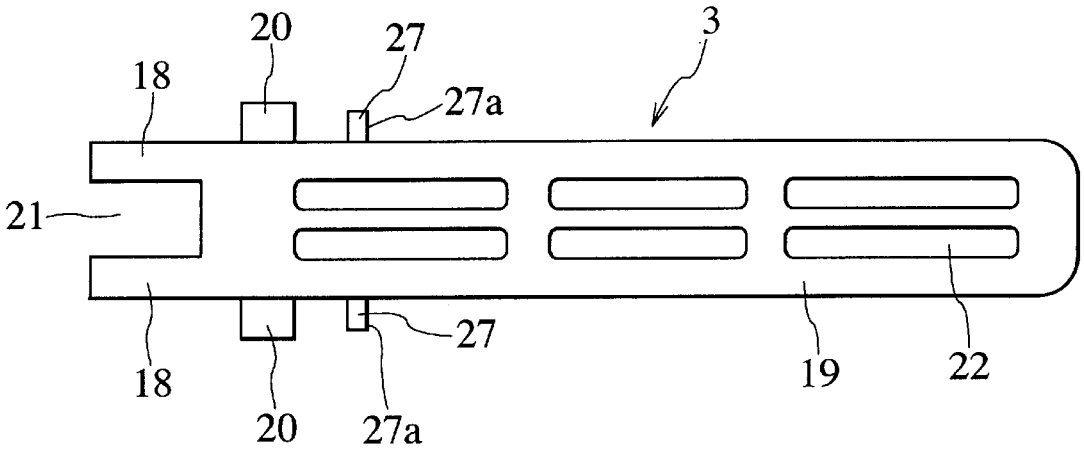
FIG. 25 is a plan view of the lever according to the second embodiment.
Figure 26:
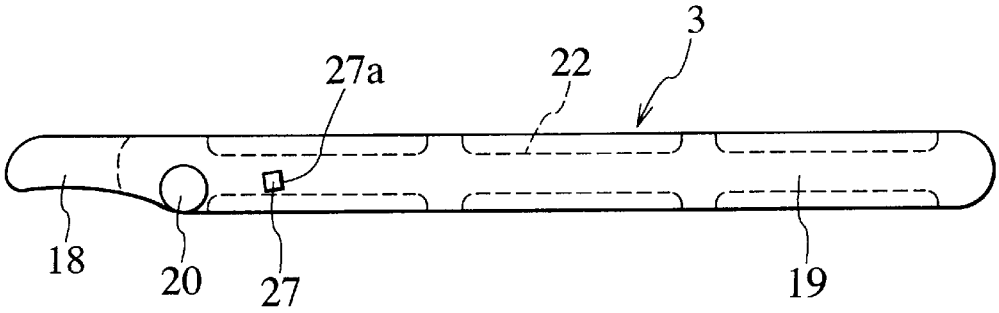
FIG. 26 is a side view of the lever according to the second embodiment.

FIGS. 17–32 show a second embodiment of the present invention. FIGS. 17–20 show the female connector 1. FIGS. 21–24 shows the male connector 2. FIGS. 25, 26 show the lever 3 and FIGS. 27–32 show an action by the operation of the lever 3. In this second embodiment, the same reference numerals are attached to the same components as in FIG. 1.

Figure 17:
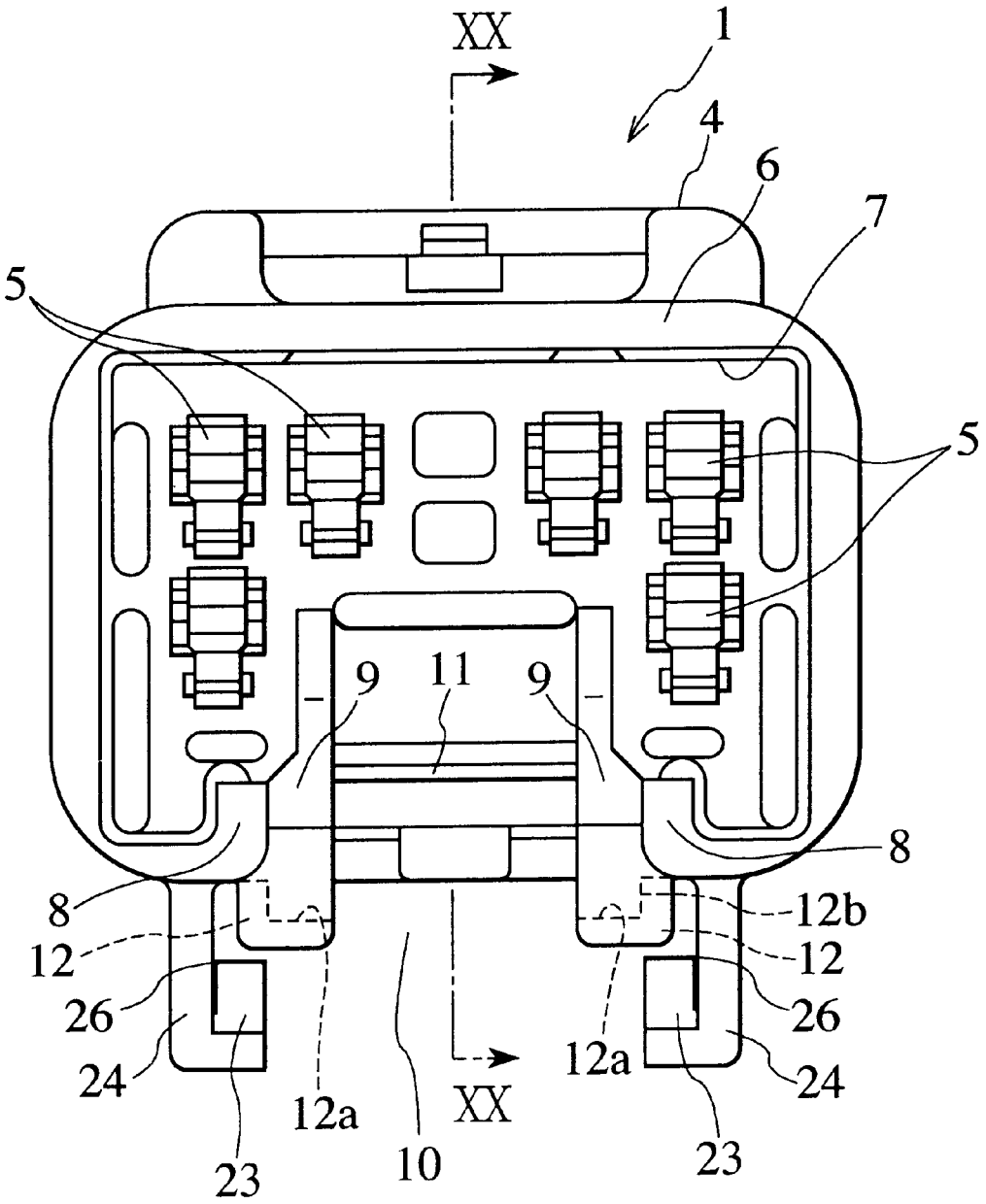
FIG. 17 is a front view of the female connector according to a second embodiment of the present invention.
Figure 18:
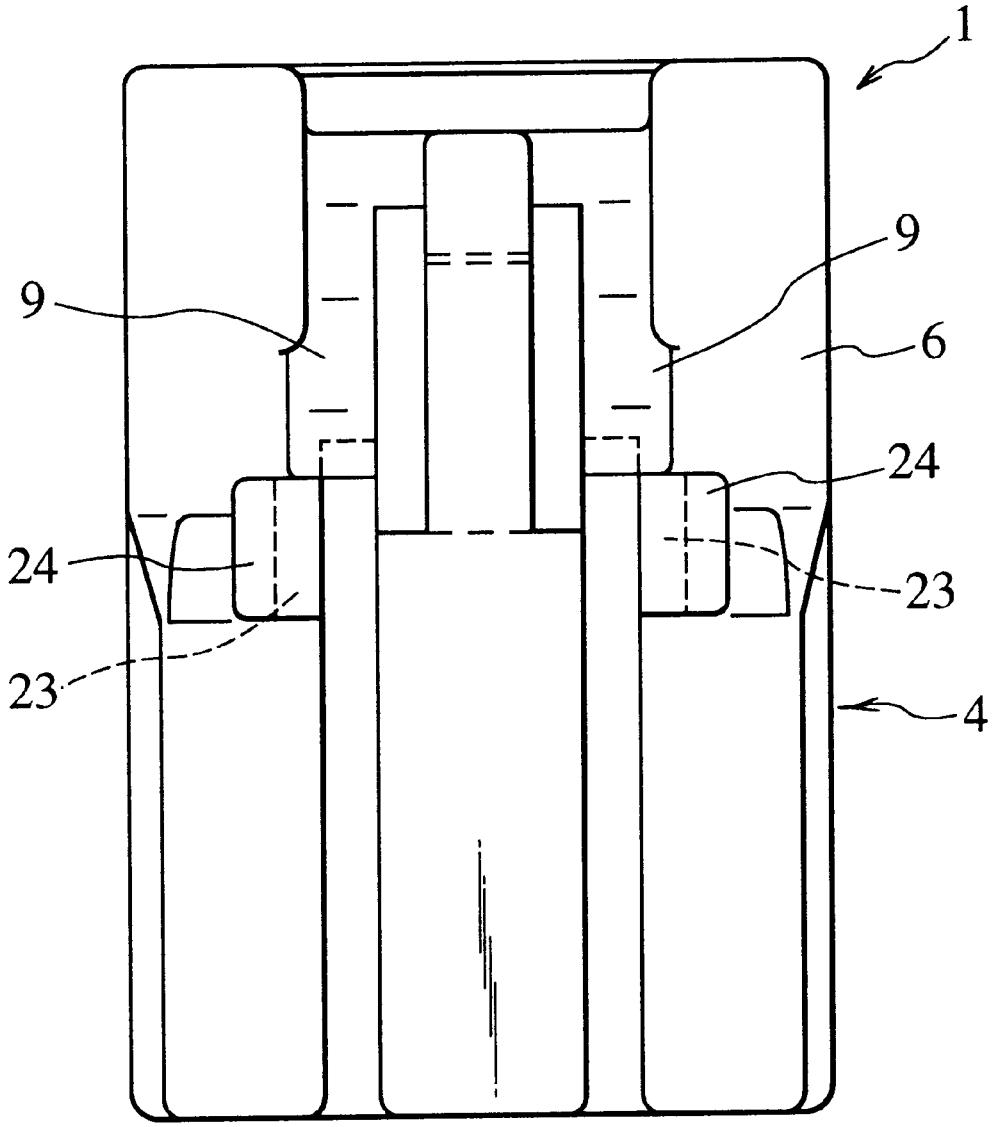
FIG. 18 is a bottom view of the female connector according to the second embodiment.
Figure 19:
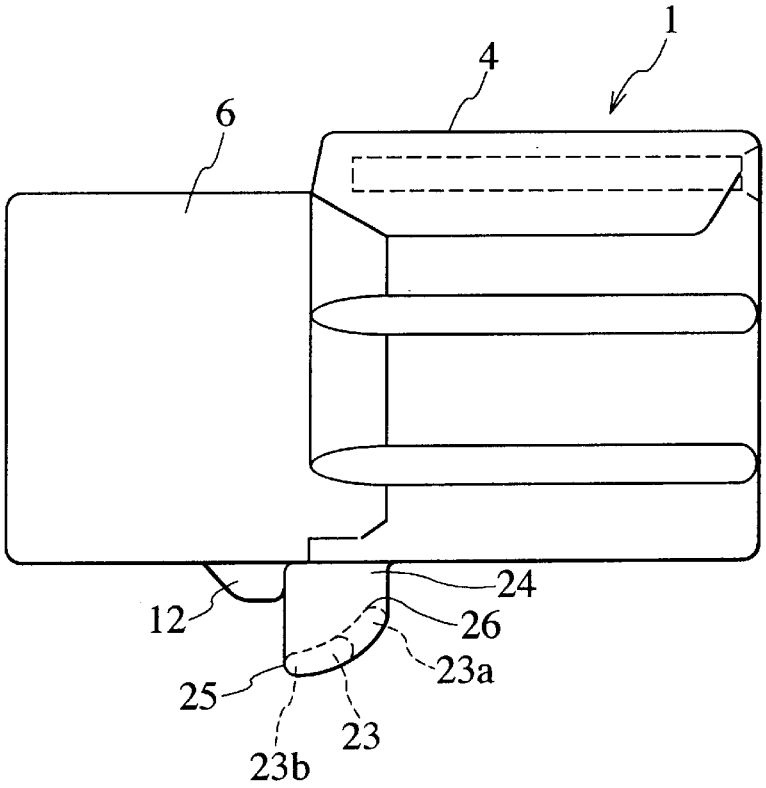
FIG. 19 is a right side view of the female connector according to the second embodiment.
Figure 20:
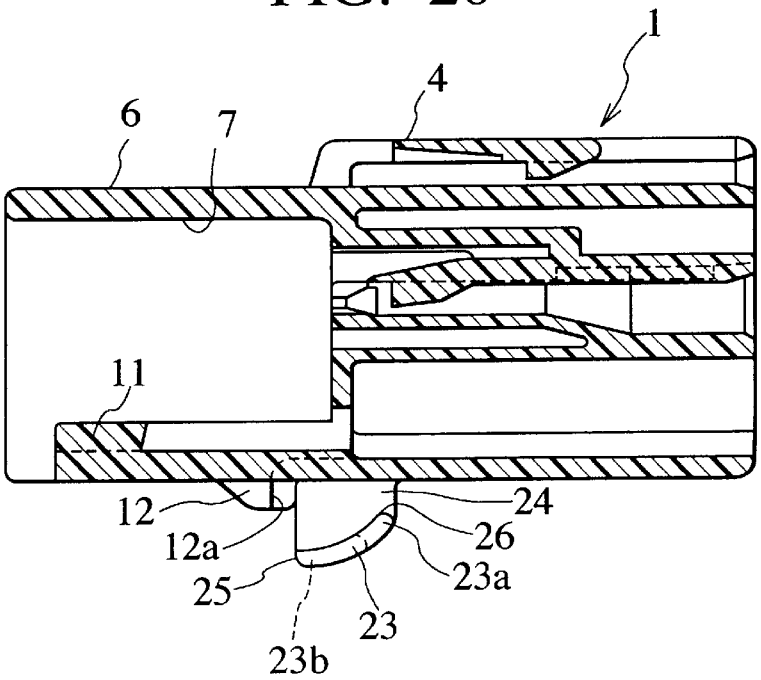
FIG. 20 is a sectional view taken along the lines XX—XX in FIG. 17.
Figure 21:
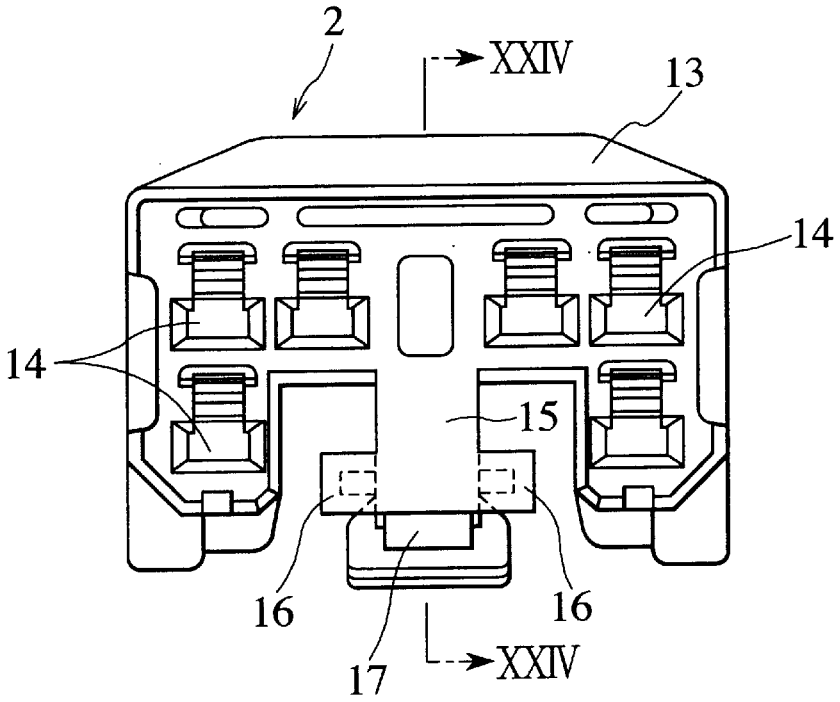
FIG. 21 is a front view of the male connector according to the second embodiment.
Figure 22:
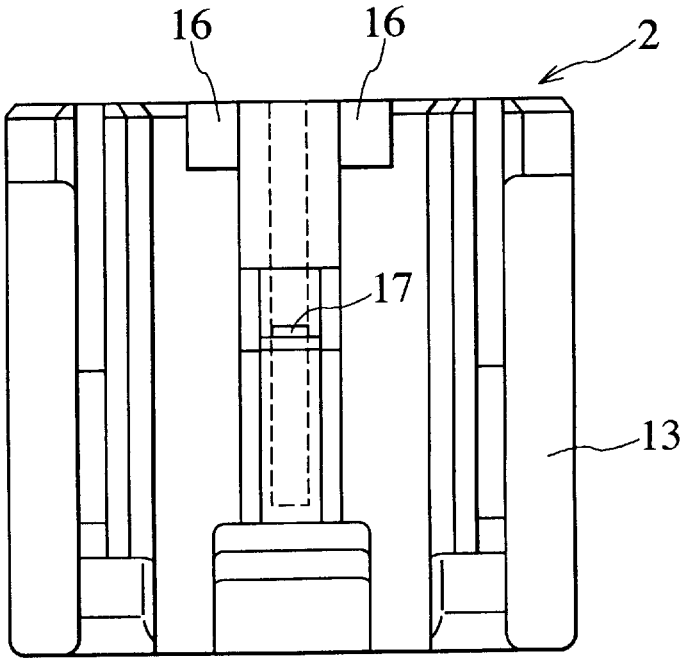
FIG. 22 is a bottom view of the male connector according to the second embodiment.
Figure 23:
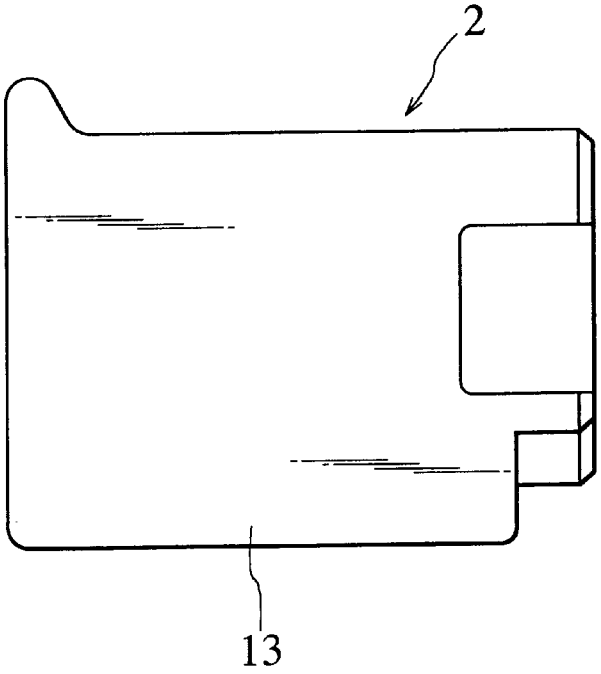
FIG. 23 is a left side view of the male connector according to the second embodiment.
Figure 24:
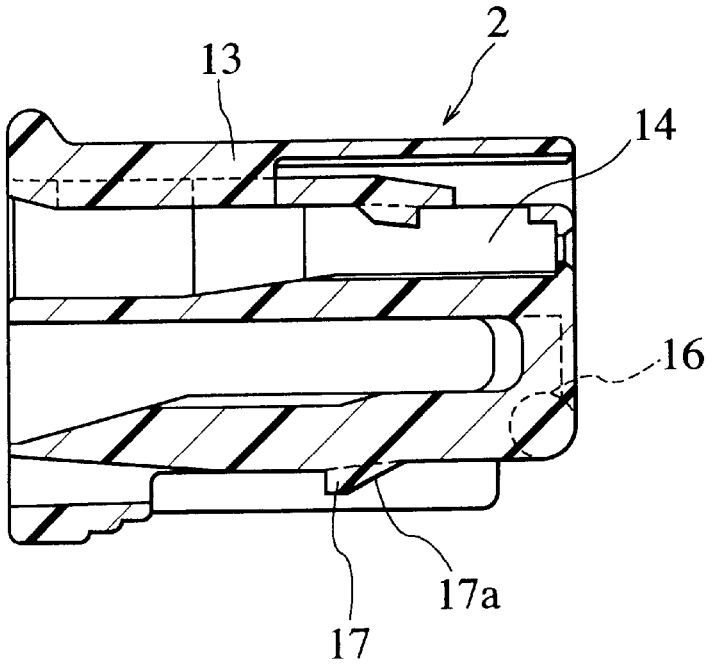
FIG. 24 is a sectional view taken along the lines XXX—XXX in FIG. 21.

In addition to the structure of the first embodiment, a pair of guide portions 23, 23 are formed in the female connector. As shown in FIGS. 17, 19, and 20, to form the guide portions 23, 23, guide portion extenders 24, 24 which are lower than the vertical walls 9, 9 are provided on a bottom face of the housing 4 of the female connector 1. The guide portions 23, 23 are formed at the distal end of the guide portion extruders 24, 24 in a curved circular shape. As described later, the guide portions 23, 23 guide the rotation of the lever 3, while being engaged with the lever 3, in such a direction that the connectors 1, 2 are engaged with each other. Curved upper end portions 23*a*, 23*a* are engaged with the lever 3 at the initial time of the rotation.

The guide portions 23, 23 are designed to be of such a length such that they are engaged with the lever 3 only in an interval of time from the initial time of the rotation of the lever 3 to completion of the engagement between the connectors 1, 2. Thus, the guide portions 23, 23 are engaged with the lever 3 in the interval of time from the initial time of the lever 3 to the completion of the engagement between the connectors 1, 2. As a result, the rotation of the lever 3 is stabilized. Further the lever 3 never disengages during the operation for the engagement of the connectors 1, 2, because the guide portions 23, 23 are engaged with the lever 3 only in this interval of time.

Lower end portions 23*b*, 23*b* of the guide portions 23, 23 are terminal portions of the engagement portions of the engagement with the lever 3, each acting as a free end. This enables the engagement with the lever 3 to be released. Thus, when the lever 3 reaches the free ends 25, 25, the lever 3 can be pulled out and removed easily from the housing 4 of the female connector 1.

Figure 28:
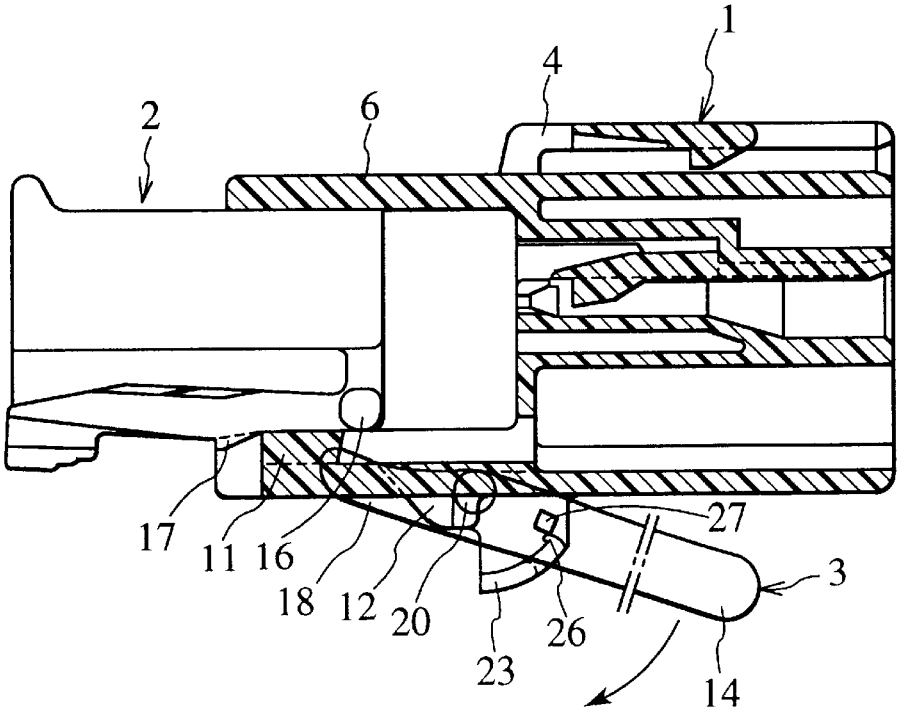
FIG. 28 is a sectional view showing an initial time of the rotation of the lever according to the second embodiment.

Enlarged stopper portions 26, 26 are formed at the upper end portions 23*a*, 23*a* of the guide portions 23, 23. As shown in FIG. 28, the stopper portions 26, 26 are engaged with the lever 3 when the lever 3 is engaged with the guide portions 23, 23, thereby preventing the lever 3 from being rotated in the direction of non-engagement or in the direction of disengagement between the connectors 1 and 2 or counter-clockwise direction as viewed in this Figure. This inhibits the lever 3 from being rotated in the disengagement direction, thereby preventing a mistake in operation.

In addition, as shown in FIG. 20, the supporting portions 12*a*, 12*a* of the bearing portions 12, 12 for receiving the rotary shafts 20 of the lever 3 are formed in the female connector such that they oppose the guide portions 23, 23.

The male connector according to this embodiment has the same structure as the first embodiment. As shown in FIGS. 21–24, the male connector contains the lock protrusion 17 which is engaged with the lock step portion 11 of the female connector 1 and the engaging protrusions 16, 16 which the engaging portions 18 of the lever 3 make contact with.

Like the first embodiment, the lever 3 contains a pair of engaging portions 18, 18 which are formed at a front end thereof such that they are branched, and a pair of the rotary shafts 20, 20. Additionally, as shown in FIG. 25, the lever 3 according to this embodiment contains guide protrusions 27, 27. The guide protrusions 27, 27 are located on a side of the operating portion 19 relative to the rotary shafts 20, 20 and protruding from the lever 3 such that they are parallel to the rotary shafts 20, 20. The guide protrusions 27, 27 slide on the guide portions 23, 23 of the female connector 1. The sliding faces 27*a*, 27*a* are formed at the same curvature as the guide portions 23, 23. Formation of the guide protrusions 27, 27 enables the lever 3 to be engaged with the guide portions 23, 23.

Next, an operation for engagement of the connectors 1 and 2 will be described with reference to FIGS. 27–32.

Figure 27:
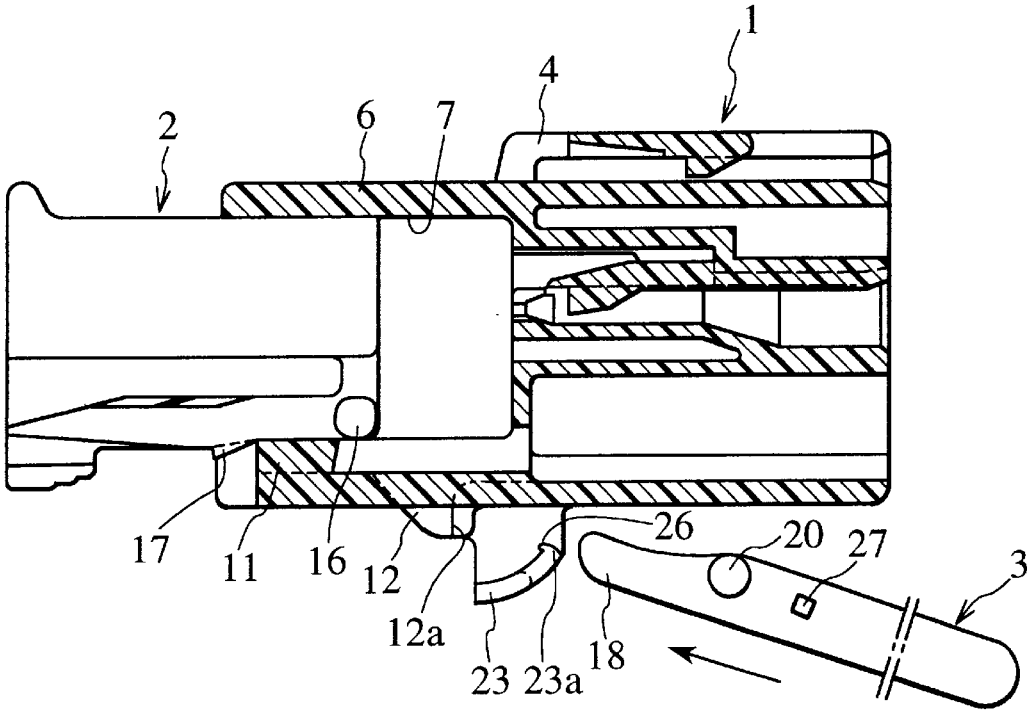
FIG. 27 is a sectional view showing a state in which the lever according to the second embodiment is mounted.

First of all, as shown in FIG. 27, the male connector 2 is inserted into the insertion port 7 through an opening end of the hood portion 6 of the female connector 1. Then, the engaging portions 18 of the lever 3 are inserted into the through portion 10 of the female connector 1. This insertion is carried out through a gap between the upper end portion 23*a* of the guide portion 23 and the housing 4 of the female connector 1 with the lever 3 being held obliquely.

As a result, the engaging portions 18 at the end of the lever 3 go through the through portion 10 of the female connector 1, as shown in FIG. 28. With this condition, the lever 3 is rotated in the clockwise direction indicated by an arrow or in such a direction that the connectors 1, 2 become engaged with each other.

Figure 29:
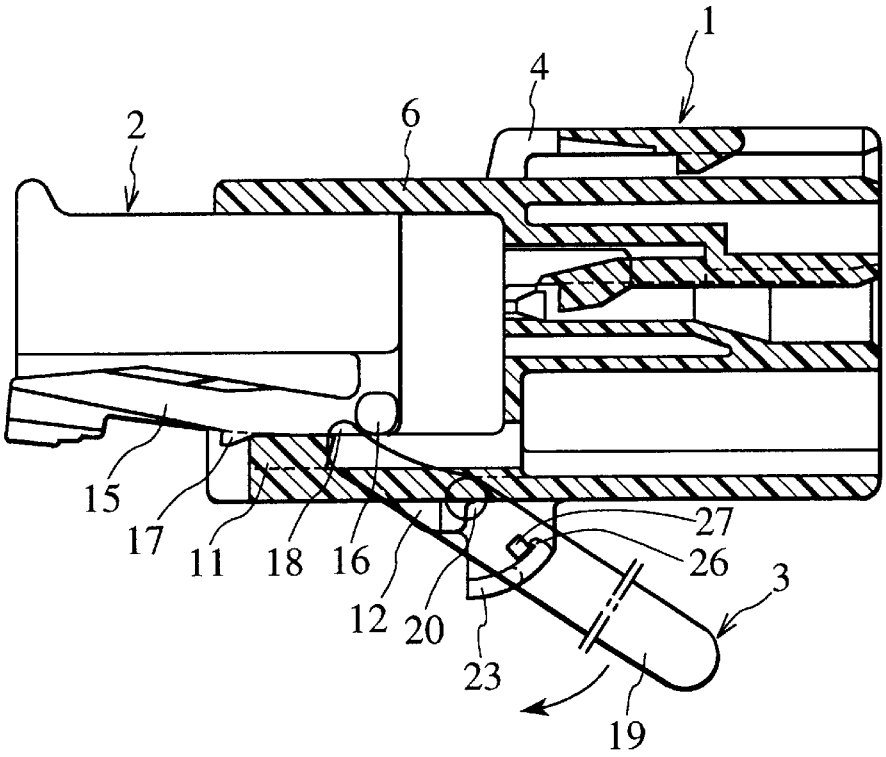
FIG. 29 is a sectional view showing a halfway stage of the rotation of the lever according to the second embodiment.

At the initial phase of the rotation of the lever 3, as shown in FIG. 29, the guide protrusions 27 of the lever 3 are engaged with the stopper portions 26 formed on the guide portions 23. As a result, the lever 3 is inhibited from rotating in the non-engagement direction (counterclockwise direction in this embodiment), so that the lever 3 is rotatable in only the direction that the connectors 1, 2 become engaged with each other. Thus, because the lever 3 cannot be rotated in the non-engagement direction, it is possible to prevent a mistake in the operation. In this condition, the rotary shafts 20, 20 of the lever 3 come into contact with the bearing portions 12, 12 of the female connector 1 and the engaging portions 18 are in contact with the engaging protrusions 16 of the male connector 2.

Figure 30:
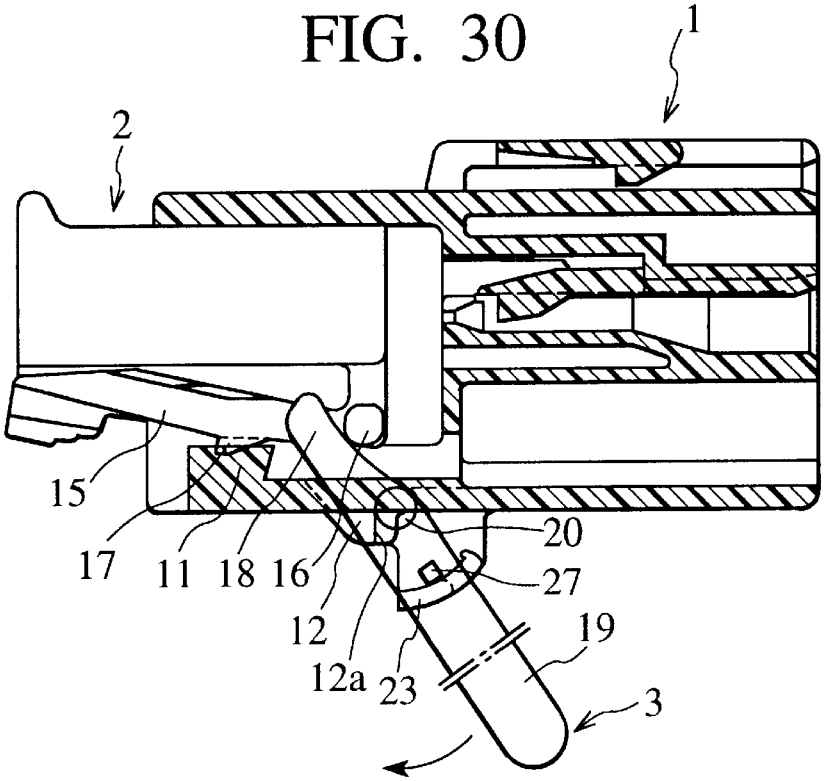
FIG. 30 is a sectional view showing a halfway stage of rotation of the lever according to the second embodiment.

Then, as shown in FIG. 30 by applying a rotation force to the operating portion 19 of the lever 3, the lever 3 is rotated in the clockwise direction indicated by an arrow, or in such a direction that the connectors 1, 2 become engaged with each other. Because the lever 3 is rotated with the rotary shafts 20, 20 thereof received by the supporting faces 12*a*, 12*a* of the bearing portions 12, 12, the rotary shafts 20, 20 act as a fulcrum such that the engaging portions 18 of the lever 3 come into contact with the engaging protrusions 16 of the male connector 2, thereby pushing the male connector 2 into the hood 6 of the female connector 1. At this time, the guide protrusions 27 of the lever 3 slide on the guide portions 23 of the female 1 so that the rotation thereof is guided. Thus, the lever 3 is stable during rotation and the lever 3 never disengages during rotation.

When the lever 3 is further rotated, the tapered face 17*a* of the lock protrusion 17 of the male connector 2 slides on the lock step portion 11 of the female connector 1. Consequently, as shown in FIG. 30, the male connector 2 is moved while the straight portion 15 of the male connector 2 is subject to elastic deformation.

Figure 31:
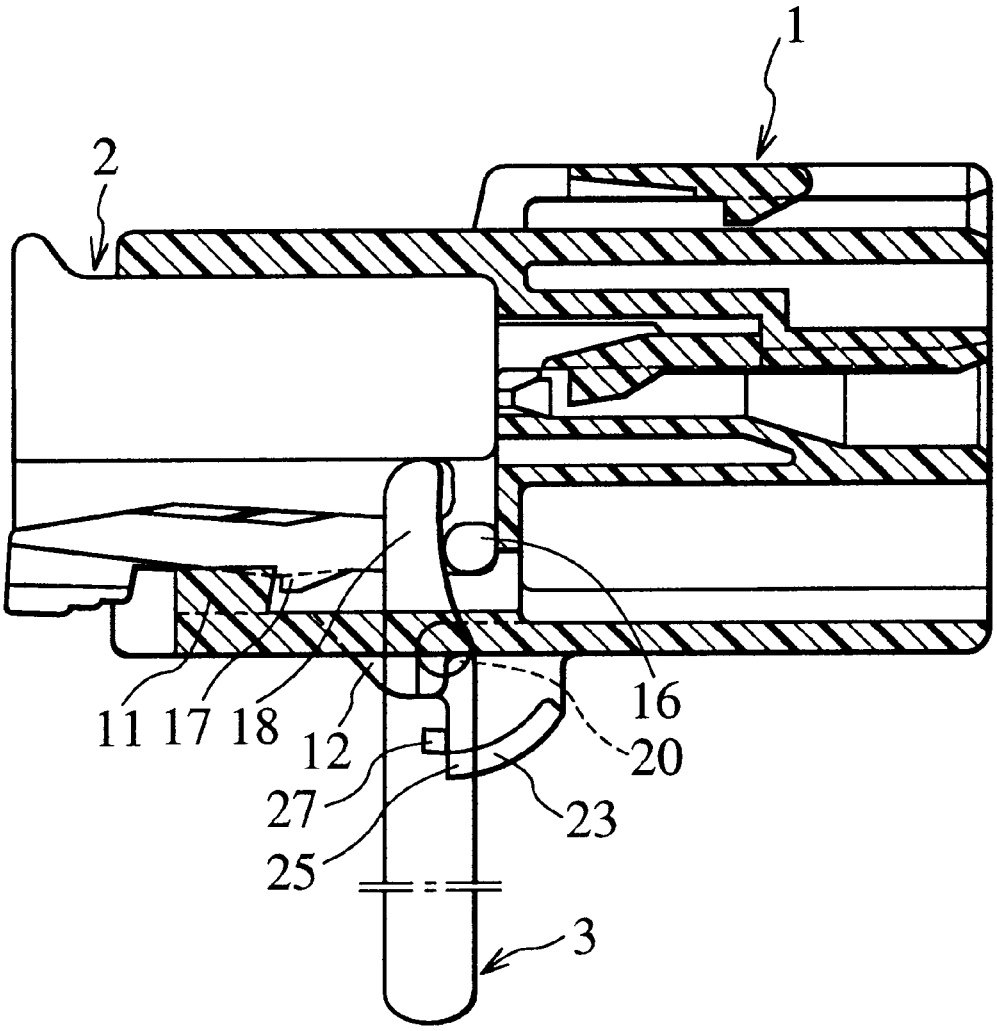
FIG. 31 is a sectional view showing a completion of the engagement according to the second embodiment.

When the lock protrusion 17 goes beyond the lock step portion 11, the straight portion 15 is released from the elastic deformation. Consequently, as shown in FIG. 31, the lock protrusion 17 meshes with the lock step portion 11. As a result, the engagement between the male connector 2 and the female connector 1 is completed. When that engagement is completed, the guide protrusion 27 of the lever 3 has reached the free ends 25 of the guide portions 23, so that the engagement between the lever 3 and the guide portions 23 can be released.

Figure 32:
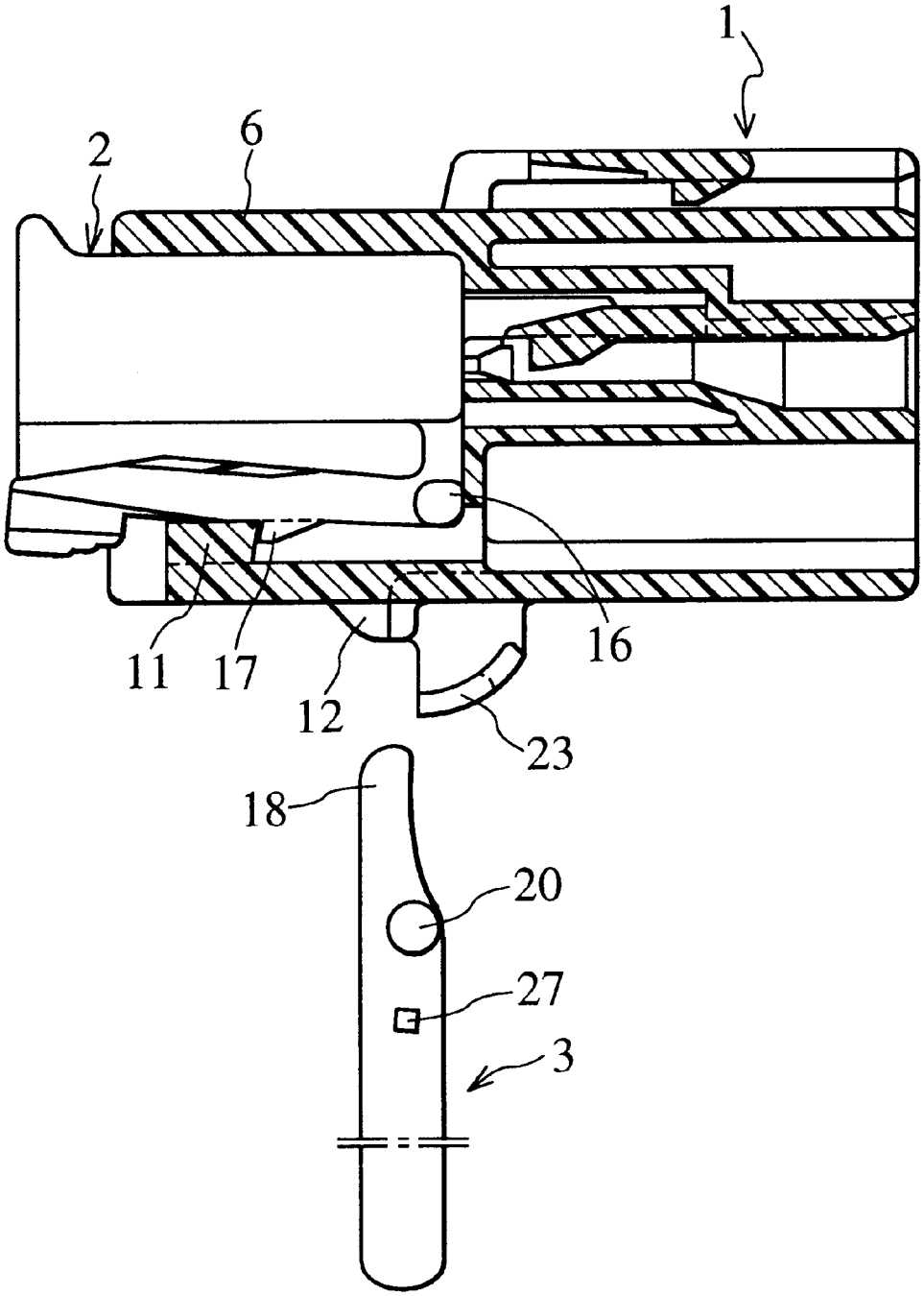
FIG. 32 is a sectional view showing a state in which the lever according to the second embodiment is removed.

Thus, the lever 3 can be removed easily from the housing 4 of the female connector 1 as shown in FIG. 32. This removal completes the operation for the engagement.

The present invention is not restricted to the above described respective embodiments, but may be modified in various ways. For example, the number of the rotary shaft 20 and the engaging portion 18 of the lever 3 may be single instead of being provided in pairs.

While preferred embodiments of the present invention have been described using specific terms, such description is for illustrative purposes, and it is to be understood that changes and variations may be made without departing from the spirit or scope of the following claims.

What is claimed is:

1. A lever engagement type connector, comprising:

a first connector having a first connector housing, the first connector housing defining a through portion for receiving a front end of a lever, the first connector further having a bearing portion for supporting the rotation of the lever; and a second connector for being connected to the first connector by the rotation of the lever, the second connector having a second connector housing, the second connector further having an engaging protrusion formed in the connector housing for being engaged with the front end of the lever for pressing the connectors into engagement, wherein the bearing portion further comprises right and left bearing portions for receiving right and left rotary shafts formed on the lever; and wherein the engaging protrusion further comprises right and left engaging protrusions for engaging right and left engaging portions formed at the front end of the lever.

2. The lever engagement type connector according to claim 1, wherein the first connector housing defines the through portion in a substantially central portion in the transverse direction of the first connector housing.

3. A lever engagement type connector, comprising:

a first connector having a first connector housing, the first connector housing defining a through portion for receiving a front end of a lever, the first connector further having a bearing portion for supporting the rotation of the lever, the first connector further having a guide portion engagedly guiding the lever in an engagement direction of the lever engagement type connector; and a second connector for being connected to the first connector by the rotation of the lever, the second connector having a second connector housing, the second connector further having an engaging protrusion formed in the connector housing for being engaged with the front end of the lever, wherein the bearing portion further comprises right and left bearing portions for receiving right and left rotary shafts formed on the lever;

wherein the engaging protrusion further comprises right and left engaging protrusions for engaging with right and left engaging portions formed at the front end of the lever; and wherein the guide portion further comprises right and left guide portions slidingly guiding right and left guide protrusions formed on the lever.

4. The lever engagement type connector according to claim 3, wherein the first connector housing defines the through portion in a substantially central portion in the transverse direction of the first connector housing.

5. The lever engagement type connector according to claim 3, wherein the guide portion has a length where the guide portion is engaged with the lever only in an interval of time from an initial time of the lever rotation to completion of the engagement between the first and the second connectors.

6. The lever engagement type connector according to claim 3, wherein the guide portion has a stopper portion being engaged with the lever at an initial time of the rotation of the lever for inhibiting the lever from being rotated in a direction where the first and the second of the connectors are disengaged.

7. The lever engagement type connector according to claim 3, wherein the terminal end portion of the guide portion is formed as a free end allowing the lever to be removed out of the connector housing of the first connector.

* * * * *